US010689800B2

(12) United States Patent
Wakimoto et al.

(10) Patent No.: US 10,689,800 B2
(45) Date of Patent: Jun. 23, 2020

(54) NUBUCK-LEATHER-LIKE SHEET AND MANUFACTURING PROCESS THEREFOR

(71) Applicant: KURARAY CO., LTD., Kurashiki-shi (JP)

(72) Inventors: Yoshiaki Wakimoto, Okayama (JP); Jiro Tanaka, Osaka (JP); Masato Warita, Okayama (JP); Rei Nagayama, Okayama (JP)

(73) Assignee: KURARAY CO., LTD., Kurashiki-shi (JP)

( * ) Notice: Subject to any disclaimer, the term of this patent is extended or adjusted under 35 U.S.C. 154(b) by 203 days.

(21) Appl. No.: 15/033,432

(22) PCT Filed: Oct. 27, 2014

(86) PCT No.: PCT/JP2014/005426

§ 371 (c)(1),
(2) Date: Apr. 29, 2016

(87) PCT Pub. No.: WO2015/064078

PCT Pub. Date: May 7, 2015

(65) Prior Publication Data

US 2016/0251797 A1 Sep. 1, 2016

(30) Foreign Application Priority Data

Nov. 1, 2013 (JP) ..... 2013-228667

(51) Int. Cl.
*D06N 3/00* (2006.01)
*D06N 3/04* (2006.01)
*D06N 3/08* (2006.01)

(52) U.S. Cl.
CPC ..... *D06N 3/004* (2013.01); *D06N 3/0004* (2013.01); *D06N 3/0011* (2013.01);
(Continued)

(58) Field of Classification Search
CPC .... D06N 3/004; D06N 3/0004; D06N 3/0011; D06N 3/0077; D06N 3/042; D06N 3/08;
(Continued)

(56) References Cited

U.S. PATENT DOCUMENTS 3,582,442 A * 6/1971 Kaneko ..... D06N 3/004 427/245
4,122,223 A * 10/1978 Civardi ..... B32B 5/24 428/91

(Continued)

FOREIGN PATENT DOCUMENTS

CN 1437532 A 8/2003
CN 1519422 A 8/2004

(Continued)

OTHER PUBLICATIONS

JP 2002-105870, JPO machine translation, 2002.*
International Search Report dated Jan. 27, 2015 in PCT/JP2014/005426 Filed Oct. 27, 2014.

*Primary Examiner* — Cheryl Juska
(74) *Attorney, Agent, or Firm* — Oblon, McClelland, Maier & Neustadt, L.L.P.

(57) ABSTRACT

Disclosed is a nubuck-finished leather-like sheet including a non-woven fabric that is an entangled body of ultrafine filaments, wherein the non-woven fabric includes a napped surface having napped fibers formed thereon, and the napped fibers are fixed to an acrylic resin on the napped surface while being laid down. Preferably, the acrylic resin is present so as to retain voids in the napped surface, while being made malleable.

5 Claims, 4 Drawing Sheets

(52) U.S. Cl.
CPC ..... *D06N 3/0077* (2013.01); *D06N 3/042* (2013.01); *D06N 3/08* (2013.01); *D06N 2211/28* (2013.01); *D10B 2403/0111* (2013.01); *Y10S 428/904* (2013.01); *Y10T 428/2395* (2015.04); *Y10T 428/23986* (2015.04)

(58) Field of Classification Search
CPC ..... D06N 2211/28; D10B 2403/0111; Y10T 428/2395; Y10T 428/23986; Y10S 428/904
See application file for complete search history.

(56) References Cited

U.S. PATENT DOCUMENTS

| | | | | |
|---|---|---|---|---|
| 8,445,391 | B2 * | 5/2013 | Nakayama | D04H 3/16 28/103 |
| 8,883,662 | B2 * | 11/2014 | Tanaka | D06N 3/0004 428/151 |
| 9,299,977 | B2 * | 3/2016 | Suematsu | H01G 11/50 |
| 9,752,260 | B2 * | 9/2017 | Fujisawa | D04H 3/105 |
| 2001/0024709 | A1 * | 9/2001 | Yoneda | A43B 1/14 428/91 |
| 2003/0203687 | A1 | 10/2003 | Akuzawa et al. | |
| 2004/0029470 | A1 * | 2/2004 | Vogt | B32B 5/18 442/104 |
| 2004/0157037 | A1 | 8/2004 | Yamaguchi et al. | |
| 2004/0224122 | A1 * | 11/2004 | Yamasaki | D06N 3/0004 428/96 |
| 2009/0075018 | A1 * | 3/2009 | Ashida | D01F 1/04 428/91 |
| 2009/0087618 | A1 * | 4/2009 | Fujisawa | D04H 1/46 428/151 |
| 2009/0274862 | A1 * | 11/2009 | Nakayama | D04H 3/16 428/91 |
| 2010/0086738 | A1 * | 4/2010 | Tanaka | D06N 3/0004 428/151 |
| 2011/0039055 | A1 * | 2/2011 | Fujisawa | D04H 3/016 428/91 |
| 2012/0028008 | A1 * | 2/2012 | Tanaka | D06P 1/16 428/212 |
| 2013/0022776 | A1 * | 1/2013 | Nakayama | D06M 15/564 428/91 |
| 2013/0055535 | A1 * | 3/2013 | Fujisawa | D04H 3/016 28/167 |
| 2016/0002846 | A1 * | 1/2016 | Yoshimoto | D06N 3/0011 428/151 |
| 2016/0215444 | A1 * | 7/2016 | Ashida | D06N 3/0075 |
| 2017/0183815 | A1 * | 6/2017 | Kuroda | D06N 3/0011 |
| 2017/0211227 | A1 * | 7/2017 | Fujisawa | D06N 3/0075 |

FOREIGN PATENT DOCUMENTS

| | | | |
|---|---|---|---|
| EP | 1 895 044 | A1 | 3/2008 |
| EP | 1 930 495 | A1 | 6/2008 |
| EP | 2 261 382 | A1 | 12/2010 |
| EP | 2 292 821 | A1 | 3/2011 |
| EP | 2 821 545 | A1 | 1/2015 |
| GB | 1 326 863 | | 8/1973 |
| JP | 55-001304 | | 1/1980 |
| JP | 11-124777 | | 5/1999 |
| JP | 2002-105870 | | 4/2002 |
| JP | 2002-161483 | A | 6/2002 |
| JP | 2004-027466 | | 1/2004 |
| JP | 2006-241620 | | 9/2006 |
| JP | 2007-204863 | | 8/2007 |
| JP | 2007-262616 | | 10/2007 |
| JP | 2010-031443 | | 2/2010 |
| JP | 2011-74541 | A | 4/2011 |

* cited by examiner

【Fig. 1】
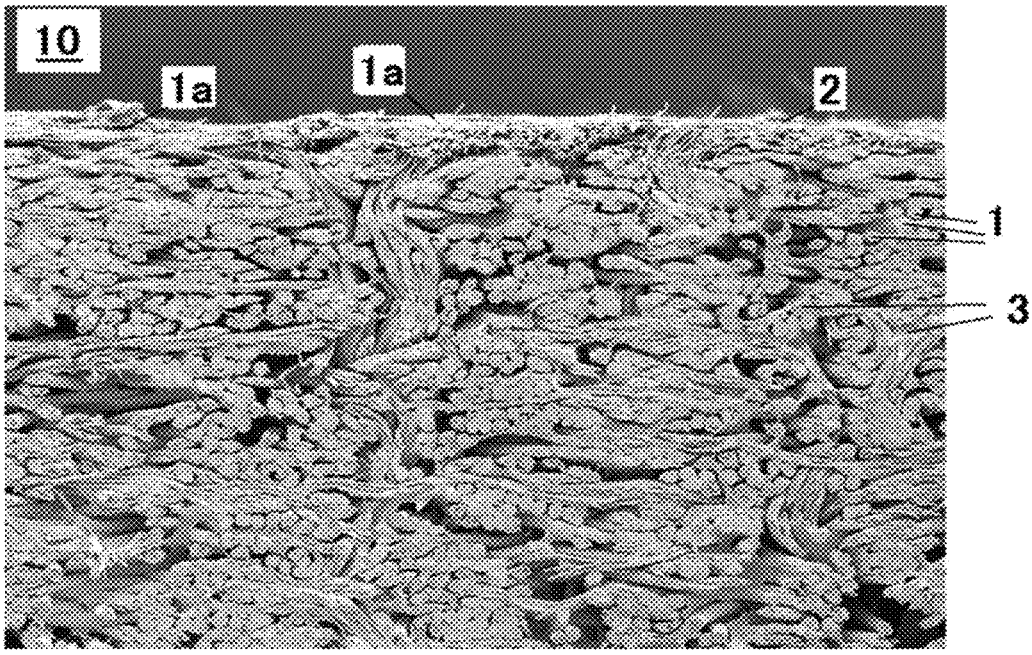

【Fig. 2】
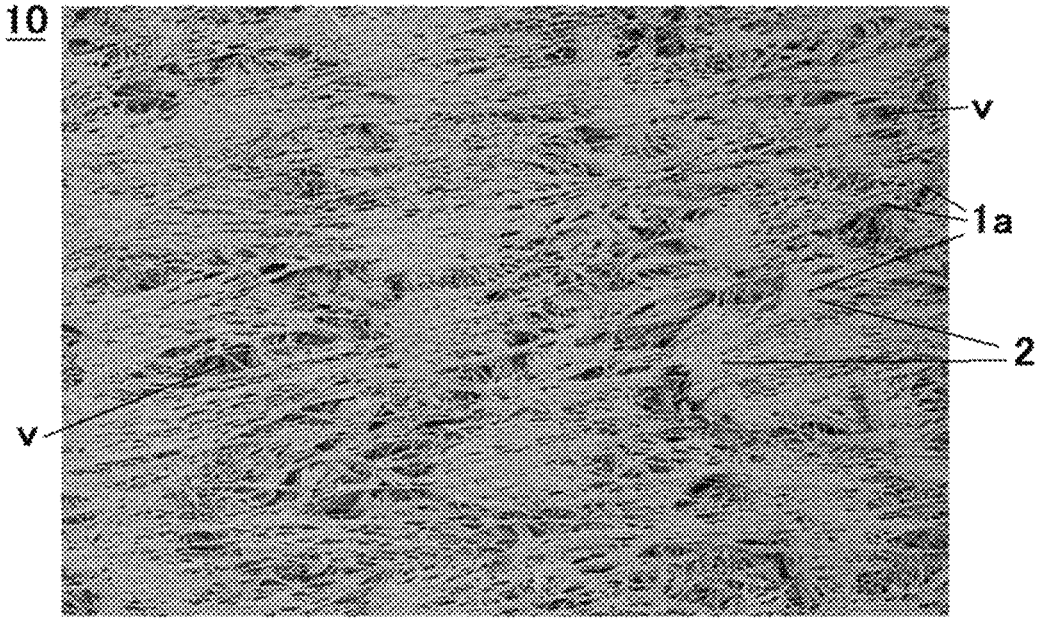

【Fig. 3】
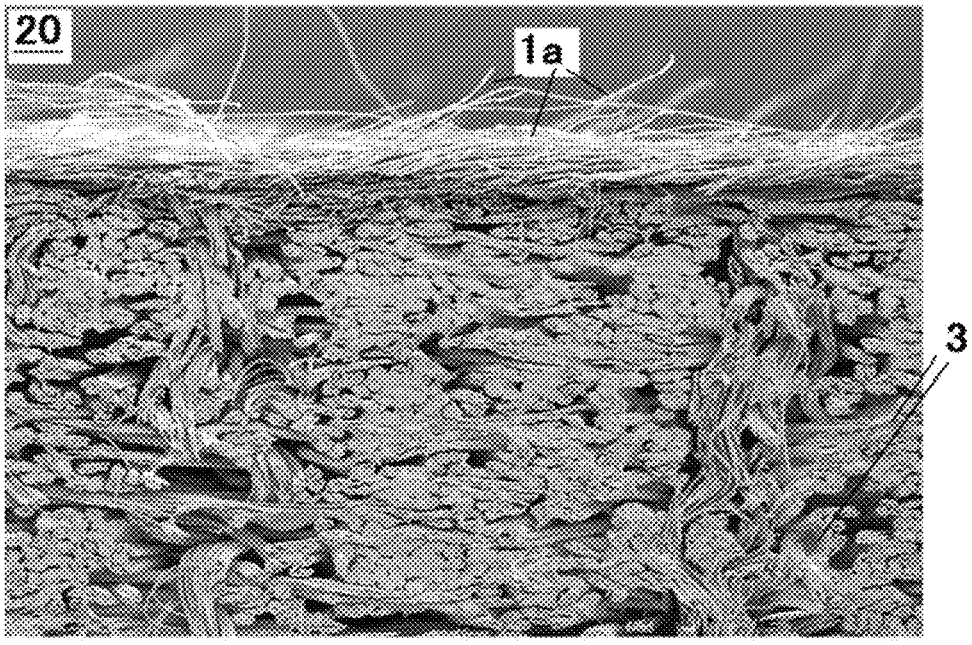

【Fig. 4】
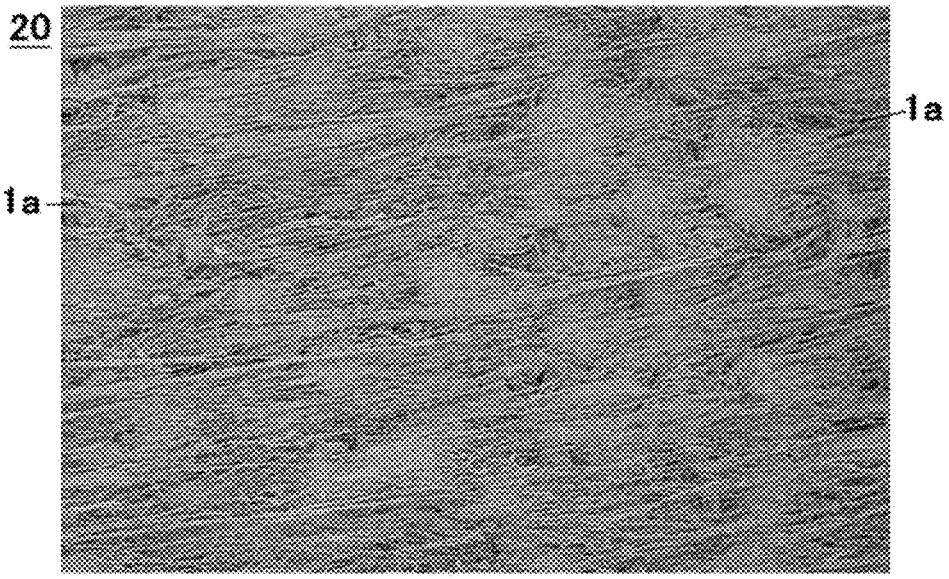

NUBUCK-LEATHER-LIKE SHEET AND MANUFACTURING PROCESS THEREFOR

TECHNICAL FIELD

The present invention relates to a nubuck-finished leather-like sheet for use as a surface material for clothing, shoes, articles of furniture, general merchandise, and the like. More particularly, the invention relates to a nubuck-finished leather-like sheet having an excellent (natural leather-like) slimy touch, which is a moist touch.

BACKGROUND ART

Conventionally, as a leather-like sheet resembling natural leather, a full grain-finished leather-like sheet provided with a grain-finished skin layer on the surface, and a suede-finished leather-like sheet or nubuck-finished leather-like sheet having a napped surface are known. In general, the surface of the nubuck-finished leather-like sheet has shorter naps than those of the surface of the suede-finished leather-like sheet.

The natural nubuck-finished leather is a leather product having a velvet-like surface that is produced by napping the grain layer of a leather by buffing. The natural nubuck-finished leather has the so-called slimy touch, which provides a moist clinging touch when being touched with a finger. In the conventional nubuck-finished leather-like sheet, it has been difficult to maintain a slimy touch that is sensed on the natural nubuck-finished leather.

As a specific example of a nubuck-finished leather-like sheet with an improved slimy touch, PTL 1 below discloses a napped leather-like sheet that includes an entangled non-woven fabric made of ultrafine fibers and an elastic polymer contained therein and includes naps made of ultrafine fibers formed on one or both surfaces thereof, wherein at least one silk protein substance selected from a silk protein and a silk protein partial hydrolysate and a softener are impregnated into a nap portion of the napped leather-like sheet and throughout the thickness of the entangled non-woven fabric containing the elastic polymer.

Also, for example, PTL 2 below discloses a nubuck-finished sheet-like material in which a foam layer made of a polyurethane resin formed by reaction between a hot-melt urethane prepolymer and a urethane curing agent is stacked on a fibrous base material including, on at least one surface thereof, pile fiber fragments made of non-loop-pile fibers, the foam layer being stacked on the surface of the fibrous base material on the side where the pile fiber fragments are included, in a state in which the foam layer coexists with the pile fiber fragments, wherein the tips of at least some of the pile fiber fragments protrude in the form of naps on the surface of the foam layer, and the surface of the protruding pile fiber fragments is covered with a protective film.

CITATION LIST

Patent Literatures

[PTL 1] Japanese Laid-Open Patent Publication No. 2002-161483

[PTL 2] Japanese Laid-Open Patent Publication No. 2010-031443

SUMMARY OF INVENTION

Technical Problem

For the conventional nubuck-finished leather-like sheet, a method has been attempted to achieve an improved slimy touch by applying a component for imparting a slimy touch to a napped non-woven fabric. However, with such a method, it has been difficult to achieve a highly slimy touch that is sensed on the natural nubuck-finished leather.

It is an object of the present invention to provide a nubuck-finished leather-like sheet having a highly slimy touch that is sensed on the natural nubuck-finished leather.

Solution to Problem

As a result of extensive studies for obtaining a nubuck-finished leather-like sheet having a highly slimy touch, the present inventors have arrived at the following insights. That is, the inventors have noticed that a slimy touch tends to be affected by a touch of the resin applied in the non-woven fabric, rather than by a touch of the napped fibers sensed when touching the nubuck-finished leather-like sheet. Also, the inventors have noticed that, when the surface on which the napped fibers are formed is touched with a finger, it is difficult to obtain a slimy touch if the movement of the napped fibers is too large. Based on these findings, the inventors have arrived at the present invention.

That is, an aspect of the present invention is a nubuck-finished leather-like sheet including a non-woven fabric that is an entangled body of ultrafine filaments (long fibers) with a fineness of 2 dtex or less, wherein the non-woven fabric includes, one or both surfaces thereof, a napped surface having napped fibers, and the napped fibers are fixed to an acrylic resin on the napped surface while being laid down. In this nubuck-finished leather-like sheet, as a result of the napped fibers present on the napped surface being fixed with the acrylic resin while being laid down, the movement of the napped fibers becomes small, and the irritation that the finger receives from the tips of the napped fibers also becomes small. Also, the finger receives a feel provided by an acrylic resin, which tends to provide a comfortable feel to fingers, is closely attached to the finger. Accordingly, when the napped surface is touched with the finger, a highly slimy touch can be sensed.

Preferably, the acrylic resin is present so as to retain voids in the napped surface, while being made malleable, or in other words, in a state in which the acrylic resin is thinly extended with plasticity by application of pressure. In this case, the napped fibers will not be fixed to the acrylic resin too firmly, and therefore, a nubuck touch can be sufficiently maintained. Also, the air-permeability required for the leather-like sheet can be ensured. Further, in the case where the napped fibers are laid down and fixed by the acrylic resin while being not fused to one another, the movement of the napped fibers when touched with a finger is ensured at a moderate level.

Also, it is preferable that the napped fibers are laid down facing in the same direction, in view of the point that a higher smoothness and hence a superior touch can be achieved.

Also, it is preferable that the nubuck-finished leather-like sheet further includes an elastic polymer different from the acrylic resin, the elastic polymer being applied in the non-woven fabric, in view of the point that the fullness and the shape stability of the non-woven fabric can be improved.

Also, it is preferable that the nubuck-finished leather-like sheet includes 1 to 20 parts by mass of the acrylic resin per 100 parts by mass of the non-woven fabric, in view of the point that the movement of the laid-down napped fibers can be suppressed at a moderate level.

Also, when the non-woven fabric further includes a softener, the flexibility of the resulting nubuck-finished leather-like sheet is improved.

Another aspect of the present invention is a production method of a nubuck-finished leather-like sheet, including the steps of: providing a non-woven fabric of ultrafine filaments with a fineness of 2 dtex or less that includes napped fibers formed by napping one or both surfaces thereof; applying an acrylic resin to a surface layer of the napped surface; and performing heated roll processing on the napped surface, thereby fixing the napped fibers to the acrylic resin with the napped fibers being laid down. With this production method, it is possible to obtain a nubuck-finished leather-like sheet having a highly slimy touch.

It is preferable that the heated roll processing is processing of pressing the napped surface with a heated roll set at a temperature higher than the softening temperature of the ultrafine filaments and is lower than the melting point, in view of the point that by softening the napped fibers to an extent that they are not fused to one another, the napped fibers can be easily fixed to the acrylic resin with the napped fibers being laid.

It is also preferable that the heated roll processing is calendering or sanforizing, in view of the point that the napped fibers laid down in the same direction can be easily fixed to the acrylic resin that has been made malleable.

Advantageous Effects of Invention

According to the present invention, it is possible to obtain a nubuck-finished leather-like sheet having a highly slimy touch close to that of a natural nubuck-finished leather.

BRIEF DESCRIPTION OF DRAWINGS

FIG. 1 is a scanning electron microscope (SEM) image of a portion of a cross section in the thickness direction of a nubuck-finished leather-like sheet according to an embodiment of the present invention.

FIG. 2 is an SEM image of a napped surface of the nubuck-finished leather-like sheet according to an embodiment of the present invention, as viewed from above.

FIG. 3 is an SEM image of a portion of a cross section in the thickness direction of a nubuck-finished leather including napped fibers that are not fixed.

FIG. 4 is an SEM image of the napped surface of a nubuck-finished leather including napped fibers that are not fixed, as viewed from above.

DESCRIPTION OF EMBODIMENT

First, an overview of a nubuck-finished leather-like sheet according to an embodiment of the present invention will be described in detail with reference to the images as substitutes for drawings shown FIGS. 1 and 2. FIG. 1 is an exemplary SEM image of a cross section in the thickness direction of a nubuck-finished leather-like sheet 10 according to the present embodiment. FIG. 2 is an exemplary SEM image of a napped surface of the nubuck-finished leather-like sheet 10 as viewed from above.

As shown in the SEM image in FIG. 1, the nubuck-finished leather-like sheet 10 includes a non-woven fabric that is an entangled body of filaments of ultrafine fibers (hereinafter also simply referred to as "ultrafine filaments") 1 with a fineness of 2 dtex or less formed in a fiber bundle. Also, napped fibers 1*a* formed by napping the ultrafine filaments 1 are formed on the surface of the non-woven fabric, and the napped fibers 1*a* are fixed with an acrylic resin 2 while being laid down on the napped surface. Further, polyurethane 3 serving as an elastic polymer is provided in internal voids of the non-woven fabric for the purpose of imparting fullness to the non-woven fabric.

As shown in FIG. 2, the acrylic resin 2 fixes the laid-down napped fibers 1*a* in a state in which the acrylic resin 2 is made malleable (state in which the acrylic resin 2 is extended by application of pressure). As a result, the movement of the napped fibers 1*a* becomes small, and the irritation that the finger receives from the tips of the napped fibers also becomes small. Also, the finger receives a feel provided by the acrylic resin, which tends to provide a comfortable feel to fingers, is closely attached to the finger. As a result, when the napped surface is touched with the finger, a highly slimy touch can be provided. Furthermore, the acrylic resin 2 is discontinuously present so as to maintain the voids. Consequently, air-permeability is also maintained.

For reference, an SEM image of a cross section in the thickness direction of a nubuck-finished leather-like sheet 20 including napped fibers 1*a* that are laid down without being fixed is shown in FIG. 3, and an SEM image of the nubuck-finished leather-like sheet 20 as viewed from above is shown FIG. 4. As shown in FIG. 3, in the case where the napped fibers 1*a* are not fixed, the napped surface lacks smoothness, and the napped fibers 1*a* move freely and largely when the surface is touched with a finger. Also, as shown in FIG. 4, the napped fibers 1*a* are exposed on the napped surface. Accordingly, when the surface is touched with a finger, the tips of the napped fibers 1*a* touch the finger and thus provide a rough dry touch, making it difficult to provide a slimy touch.

The nubuck-finished leather-like sheet according to the present embodiment will be described in further detail, in conjunction with an exemplary production method thereof.

The nubuck-finished leather-like sheet of the present embodiment can be produced by a production method including the steps of: providing a non-woven fabric of ultrafine filaments that includes napped fibers formed by napping one or both surfaces thereof; applying an acrylic resin to a surface layer of the napped surface; and performing heated roll processing on the napped surface, thereby fixing the napped fibers to the acrylic resin with the napped fibers being laid down.

In the production method of the nubuck-finished leather-like sheet according to the present embodiment, first, a non-woven fabric of ultrafine filaments that includes napped fibers formed by napping one or both surfaces thereof is provided.

In the production of the non-woven fabric of ultrafine filaments, first, a filament web of ultrafine fiber-generating fibers is produced. Examples of the production method of the filament web include a method involving melt-spinning ultrafine fiber-generating fibers and directly collecting the resultant fibers without intentionally cutting them.

"Ultrafine fiber-generating fiber" refers to a fiber that forms ultrafine fibers with a small fineness as a result of performing a chemical or physical post-treatment on the spun fibers. Specific examples thereof include an island-in-the-sea composite fiber in which a polymer of an island component serving as a domain different from a sea component is dispersed in a polymer of the sea component serving as a matrix on the fiber cross section, and the sea component is later removed to form a fiber bundle-like ultrafine fiber composed mainly of the island component polymer; and a strip/division-type composite fiber in which a plurality of different resin components are alternately disposed around the periphery of a fiber to form a petaline shape or a superposed shape, and the fiber is divided as a result of the resin components being stripped from the fiber by a physical treatment, thereby forming a bundle-like ultrafine fiber. The use of the island-in-the-sea composite fiber can prevent damage to the fibers such as cracking, bending, and breaking during an entangling treatment such as needle punching, which will be described below. In the present embodiment, the formation of ultrafine fibers by using the island-in-the-sea composite fiber will be described in detail as a representative example.

The island-in-the-sea composite fiber is a multicomponent composite fiber composed of at least two polymers, and has a cross section on which an island component polymer is dispersed in a matrix composed of a sea component polymer. A filament web of the island-in-the-sea composite fiber is formed by melt-spinning the island-in-the-sea composite fiber and directly collecting the resultant fiber as a filament on a net without cutting it. Here, "filament" mean that the fibers are not short fibers that have been cut into a predetermined length. From the viewpoint of sufficiently increasing the fiber density, the length of the filaments is preferably 100 mm or more, more preferably 200 mm or more. Although the upper limit is not particularly limited, the filaments may be continuously spun fibers having a fiber length of several meters, several hundred meters, several kilometers, or more.

The island component polymer is not particularly limited so long as it is a polymer capable of forming an ultrafine fiber. Specific examples thereof include polyester resins such as polyethylene terephthalate (PET), polytrimethylene terephthalate (PTT), polybutylene terephthalate and a polyester elastic body or modified products thereof with isophthalic acid or the like; polyamide resins such as polyamide 6, polyamide 66, polyamide 610, polyamide 12, an aromatic polyamide, a semi-aromatic polyamide, a polyamide elastic body or modified products thereof; polyolefin resins such as polypropylene; and polyurethane resins such as a polyester polyurethane. Among these, polyester resins such as PET, PTT, PBT and modified polyesters thereof are preferable in that they are easily shrinkable by a heat treatment and thus can provide a nubuck-finished leather-like sheet having fullness. Also, polyamide resins such as polyamide 6 and polyamide 66 are preferable in that they can provide an ultrafine filament having hygroscopicity and pliability as compared with those obtained by polyester resins, and thus can provide a nubuck-finished leather-like sheet having fluffiness and a soft texture.

Note that a partially oriented fibers (POY) made of a modified polyester including a crystalline polymer is particularly preferable as the island component polymer. Such a partially oriented fibers has a melting point peak, and also has an endothermic peak (hereinafter also referred to as "endothermic sub-peak") of a temperature lower than the melting point peak. Note that the melting point peak is a top temperature of an endothermic peak measured with a differential scanning calorimeter (DSC) by initially melting and solidifying a polymer, and thereafter further melting the polymer by heating at a constant speed. The endothermic sub-peak is an endothermic peak that is lower than the melting point peak and appears when the polymer is initially heated with the DSC at a constant speed to melt the polymer.

When the ultrafine fibers have such an endothermic sub-peak, the ultrafine fibers are easily softened by being heated to a temperature greater than or equal to an endothermic sub-peak temperature, which is lower than a melting point peak temperature. Accordingly, by performing heated roll processing on the surface on the side where the napped fibers are included, which will be described later, the napped fibers are softened and easily laid down without being substantially fused to one another. Consequently, a smooth surface can be readily formed. The melting point peak temperature is in the range of, for example, preferably 160° C. or more, more preferably 180 to 330° C., and the endothermic sub-peak temperature is lower than the melting point peak temperature preferably by 30° C. or more, more preferably by 50° C. or more.

As the sea component polymer, a polymer having higher solubility in a solvent or higher decomposability by a decomposition agent than those of the island component polymer is selected. Also, a polymer having low affinity for the island component polymer and a smaller melt viscosity and/or surface tension than the island component polymer under the spinning condition is preferable in terms of the excellent stability in spinning of the island-in-the-sea composite fiber. Specific examples of the sea component polymer satisfying such conditions include a water-soluble polyvinyl alcohol resin (water-soluble PVA), polyethylene, polypropylene, polystyrene, an ethylene-propylene copolymer, an ethylene-vinyl acetate copolymer, a styrene-ethylene copolymer, and a styrene-acrylic copolymer. Among these, the water-soluble PVA is preferable in that it can be removed by dissolution by using an aqueous medium without using an organic solvent and thus has a low environmental load.

The island-in-the-sea composite fiber can be produced by melt spinning in which the sea component polymer and the island component polymer are melt-extruded from a multicomponent fiber spinning spinneret. The temperature of the multicomponent fiber spinning spinneret is not particularly limited so long as it is a temperature at which melt spinning can be performed and is higher than the melting point of each of the polymers constituting the island-in-the-sea composite fiber, but is usually selected from the range of 180 to 350° C.

The fineness of the island-in-the-sea composite fiber is not particularly limited, but is preferably 0.5 to 10 dtex, more preferably 0.7 to 5 dtex. An average area ratio between the sea component polymer and the island component polymer on the cross section of the island-in-the-sea composite fiber is preferably 5/95 to 70/30, more preferably 10/90 to 30/70. The number of domains of the island component on the cross section of the island-in-the-sea composite fiber is not particularly limited, but is preferably about 5 to 1000, more preferably about 10 to 300, from the viewpoint of the industrial productivity.

The molten island-in-the-sea composite fiber discharged from the spinneret is cooled by a cooling apparatus, and is further drawn out and attenuated with a high-velocity air stream at a velocity corresponding to a take-up speed of 1000 to 6000 m/min by a suction apparatus such as an air jet nozzle so as to have a desired fineness. Then, the drawn and attenuated filaments are piled on a collection surface of a movable net or the like, thereby obtaining a filament web. Note that, in order to stabilize the shape, a part of the filament web may be further pressure-bonded by pressing the filament web if necessary. The weight per area of the filament web obtained in this manner is not particularly limited, but is preferably in the range of 10 to 1000 g/m$^2$, for example.

Then, the obtained filament web is subjected to an entangling treatment, thereby producing an entangled web.

Specific examples of the entangling treatment for the filament web include a treatment in which a plurality of layers of filament webs are superposed in the thickness direction by using a cross lapper or the like, and subsequently needle-punched simultaneously or alternately from both sides such that at least one barb penetrates the web.

The punching density is in the range of preferably 300 to 5000 punch/cm$^2$, more preferably 500 to 3500 punch/cm$^2$. In the case of such a punching density, it is possible to obtain sufficient entanglement, and also to suppress damage to the island-in-the-sea composite fiber caused by the needles.

An oil solution, an antistatic agent and the like may be added to the filament web in any stage from the spinning step to the entangling treatment of the island-in-the-sea composite fiber. Furthermore, if necessary, the entangled state of the filament web may be densified in advance by performing a shrinking treatment in which the filament web is immersed in warm water at about 70 to 150° C. Also, after needle punching, hot pressing may be performed to further increase the fiber density, thus imparting the shape stability. The weight per area of the entangled web obtained in this manner is preferably in the range of about 100 to 2000 g/m$^2$.

If necessary, the entangled web may be subjected to a treatment in which the entangled web is heat-shrunk such that the fiber density and the degree of entanglement thereof are increased. Specific examples of the heat shrinking treatment include a method involving bringing the entangled web into contact with water vapor, and a method involving applying water to the entangled web, and subsequently heating the water applied to the entangled web by using hot air or electromagnetic waves such as infrared rays. For the purpose of, for example, further densifying the entangled web that has been densified by the heat-shrinking treatment, fixing the shape of the entangled web, and smoothing the surface thereof, the fiber density may be further increased by performing hot pressing as needed.

The change in the weight per area of the entangled web during the heat-shrinking treatment step is preferably 1.1 times (mass ratio) or more, more preferably 1.3 times or more and 2 times or less, further preferably 1.6 times or less, as compared with the weight per area before the shrinking treatment.

Then, the sea component polymer is removed from the island-in-the-sea composite fiber in the entangled web that has been densified, thereby obtaining a non-woven fabric of ultrafine filaments that is an entangled body of fiber bundles of ultrafine filaments. As the method for removing the sea component polymer from the island-in-the-sea composite fiber, a conventionally known ultrafine fiber formation method such as a method involving treating the entangled web with a solvent or decomposition agent capable of selectively removing only the sea component polymer can be used without any particular limitation. Specifically, in the case of using, for example, a water-soluble PVA as the sea component polymer, it is possible to use hot water as the solvent. In the case of using a modified polyester that is easily decomposed by alkali as the sea component polymer, it is possible to use an alkaline decomposition agent such as an aqueous sodium hydroxide solution.

In the case of using the water-soluble PVA as the sea component polymer, it is preferable to remove the water-soluble PVA by extraction until the removal rate of the water-soluble PVA becomes about 95 to 100 mass % by treating the web in hot water at 85 to 100° for 100 to 600 seconds. Note that the water-soluble PVA can be efficiently removed by extraction by repeating a dip-nipping treatment. The use of the water-soluble PVA is preferable in terms of a low environmental load and reduced generation of VOCs since the sea component polymer can be selectively removed without using an organic solvent.

The fineness of the ultrafine fiber formed in this manner is preferably 2 dtex or less, more preferably in the rage of 0.001 to 2 dtex, further preferably in the range of 0.002 to 0.2 dtex.

The weight per area of the non-woven fabric of ultrafine filaments obtained in this manner is preferably 140 to 3000 g/m$^2$, more preferably 200 to 2000 g/m$^2$. The apparent density of the non-woven fabric of ultrafine filaments is preferably 0.45 g/cm$^3$ or more, more preferably 0.55 g/cm$^3$ or more, in view of the point that a dense non-woven fabric can be formed, and thus a non-woven fabric with fullness can be obtained. Although the upper limit is not particularly limited, the apparent density is preferably 0.70 g/cm$^3$ or less in view of the point that a pliable texture can be obtained and excellent productivity can also be achieved.

In the production of the nubuck-finished leather-like sheet according to the present embodiment, it is preferable to provide an elastic polymer in the internal voids of the non-woven fabric of ultrafine filaments in order to impart shape stability and fullness to the non-woven fabric of ultrafine filaments.

Examples of the method for providing an elastic polymer in the internal voids of the non-woven fabric of ultrafine filaments include a method involving impregnating a resin solution such as an emulsion or an aqueous dispersion of an elastic polymer into a densified entangled web or a non-woven fabric that has been subjected to a treatment to generate ultrafine fibers, and thereafter solidifying the elastic polymer. Examples of the solidification method include a dry solidification method in which the resin solution is solidified by being heated, and a wet solidification method in which the elastic polymer is solidified by being immersed in a solidification liquid. Also, a colorant such as a dye or a pigment, a migration preventing agent such as a thermal gelation agent for suppressing uneven distribution of the resin solution in the surface layer, an antimicrobial, a deodorant, a penetrant, an antifoaming agent, a lubricant, an oil-repellent agent, a thickener, and a water-soluble polymer compound such as polyvinyl alcohol and carboxymethyl cellulose may be blended in the resin solution so long as the effects of the present invention are not impaired.

Specific examples of the elastic polymer include elastic bodies such as a polyurethane resin, an acrylic resin, an acrylonitrile resin, an olefin resin, and a polyester resin. Among these, it is particularly preferable to use a polyurethane resin and an acrylic resin. The content ratio of the elastic polymer is preferably 0.1 to 60 mass %, more preferably 0.5 to 60 mass %, particularly preferably 1 to 50 mass %, relative to the mass of the non-woven fabric. An excessively high content ratio of the elastic polymer tends to give rise to a reduction in air-permeability.

In this manner, a base material of the non-woven fabric of ultrafine filaments is obtained. The base material of the non-woven fabric of ultrafine filaments is sliced into a plurality of pieces or ground in a direction perpendicular to the thickness direction so as to regulate the thickness thereof, and is further napped by buffing at least one surface with sand paper or the like. In this manner, the base material is finished into a non-woven fabric of ultrafine filaments that has a napped surface obtained by forming napped fibers on one or both surfaces.

The thickness of the non-woven fabric of ultrafine filaments that has the napped surface is not particularly limited, but is preferably 50 to 200 microns, more preferably 70 to 150 microns. Also, the average length of the napped fibers on the napped surface is not particularly limited, but is preferably 50 to 200 microns, more preferably 70 to 150 microns, from the viewpoint of providing an excellent nubuck texture.

The non-woven fabric may be dyed as needed. A suitable dye is selected as appropriate according to the type of the ultrafine filaments. For example, when the ultrafine filaments are formed from a polyester resin, it is preferable that the non-woven fabric is dyed with a disperse dye. Specific examples of the disperse dye include benzene azo-based dyes (e.g., monoazo and disazo), heterocyclic azo-based dyes (e.g., thiazole azo, benzothiazole azo, quinoline azo, pyridine azo, imidazole azo, and thiophene azo); anthraquinone-based dyes, and condensate-based dyes (e.g., quinophthalone, styryl, and coumarin). These are commercially available as dyes with the prefix "Disperse", for example. These may be used alone or in a combination of two or more. As the dyeing method, it is possible to use a high-pressure jet dyeing method, a jigger dyeing method, a thermosol continuous dyeing machine method, a dyeing method using a sublimation printing process, and the like without any particular limitation.

The thus obtained non-woven fabric of ultrafine filaments that has a napped surface is impregnated with a resin solution containing an acrylic resin, such as an acrylic resin emulsion, and the acrylic resin is solidified from the resin solution.

Examples of the acrylic resin includes, but is not particularly limited to, a water-dispersible, emulsifiable, or water-soluble polymer obtained by polymerization of a soft monomer, a hard monomer and a cross-linkable monomer, and other optional monomers that are used as needed.

A soft monomer is a monomer component having a non-cross-linkable ethylenic unsaturated bond, the homopolymer of which has a glass transition temperature (Tg) of less than −5° C., preferably −90° C. or more and less than −5° C. Specific examples of the soft monomer include (meth)acrylic acid derivatives such as ethyl acrylate, n-butyl acrylate, isobutyl acrylate, isopropyl acrylate, n-hexyl (meth)acrylate, 2-ethylhexyl (meth)acrylate, lauryl (meth) acrylate, stearyl (meth)acrylate, cyclohexyl acrylate, benzyl acrylate, 2-hydroxyethyl acrylate, and 2-hydroxypropyl acrylate.

A hard monomer is a monomer component having a non-crosslinking ethylenic unsaturated bond, the homopolymer of which has a Tg exceeding 50° C., preferably exceeding 50° C. and 250° C. or less. Specific examples of the hard monomer include (meth)acrylic acid derivatives such as methyl methacrylate, ethyl methacrylate, isopropyl methacrylate, isobutyl methacrylate, cyclohexyl methacrylate, (meth)acrylic acid, dimethylamino ethyl methacrylate, diethyl amino ethyl methacrylate and 2-hydroxyethyl methacrylate; aromatic vinyl compounds such as styrene, α-methyl styrene and p-methyl styrene; acrylamides such as (meth)acrylamide and diacetone (meth)acrylamide; maleic acid, fumaric acid, itaconic acid and derivatives thereof; heterocyclic vinyl compounds such as vinyl pyrrolidone; vinyl compounds such as vinyl chloride, acrylonitrile, vinyl ether, vinyl ketone and vinyl amide; and α-olefins typified by ethylene and propylene.

A cross-linkable monomer is mono- or multifunctional ethylenically unsaturated monomer unit capable of forming a cross-linked structure, or a monomer capable of forming a cross-linked structure by reacting with an ethylenically unsaturated monomer unit introduced in a polymer chain. Specific examples of such a cross-linkable monomer include di(meth)acrylates such as ethylene glycol di(meth)acrylate, triethylene glycol di(meth)acrylate, polyethylene glycol di(meth)acrylate, 1,4-butanediol di(meth)acrylate, 1,6-hexanediol di(meth)acrylate, 1,9-nonanediol di(meth)acrylate, neopentyl glycol di(meth)acrylate, dimethylol tricyclodecane di(meth)acrylate and glycerin di(meth)acrylate; tri (meth)acrylates such as trimethylol propane tri(meth) acrylate and pentaerythritol tri(meth)acrylate; tetra(meth) acrylates such as pentaerythritol tetra(meth)acrylate; multifunctional aromatic vinyl compounds such as divinyl benzene and trivinyl benzene; (meth)acrylic unsaturated esters such as allyl (meth)acrylate and vinyl (meth)acrylate; urethane acrylates having a molecular weight of 1500 or less, such as 2:1 adduct of 2-hydroxy-3-phenoxypropyl acrylate and hexamethylene diisocyanate, 2:1 adduct of pentaerythritol triacrylate and hexamethylene diisocyanate and 2:1 adduct of glycerin dimethacrylate and tolylene diisocyanate; (meth)acrylic acid derivatives having a a hydroxyl group, such as 2-hydroxyethyl (meth)acrylate, 2-hydroxypropyl (meth)acrylate; acrylamides such as (meth)acrylamide and diacetone (meth)acrylamide and derivatives thereof; (meth)acrylic acid derivatives having an epoxy group, such as glycidyl(meth)acrylate; vinyl compounds having a carboxyl group, such as (meth)acrylic acid, maleic acid, fumaric acid and itaconic acid; and vinyl compounds having an amide group, such as vinyl amide.

The above-described various monomers may be used alone or in a combination of two or more. The Tg of such an acrylic resin is preferably −80 to 40° C., more preferably −60 to 20° C.

The content ratio of the acrylic resin to the non-woven fabric is preferably 1 to 30 parts by mass, more preferably 2 to 20 parts by mass, particularly preferably 5 to 10 parts by mass, per 100 parts by mass of the non-woven fabric. An excessively low content ratio of the acrylic resin tends to reduce the bonding property, making it difficult to fix the laid-down napped fibers. An excessively high content ratio of the acrylic resin tends to restrict the movement of the napped fibers too much or to result in a grain-finished surface, leading to a loss of the nubuck texture.

Further, it is preferable to blend a softener with the resin solution containing the acrylic resin. Specific examples of such a softener include polyoxyethylene hardened castor oil ether, sorbitan monooleate, and triglyceride (neatsfoot oil), which are synthesized based on a vegetable oil such as animal oil and/or sunflower oil. Note that in the case of using an emulsion of the acrylic resin, it is preferable that the softener is also emulsified from the viewpoint of achieving excellent miscibility. Blending the softener in this manner imparts flexibility to the non-woven fabric. The content ratio of the softener is preferably about 5 to 50 parts by mass per 100 parts by mass of the non-woven fabric.

While the drying conditions for solidifying the acrylic resin in the case of using an emulsion of the acrylic resin are not particularly limited, specific examples of the drying method include a method in which the acrylic resin is heated for 0.5 to 30 minutes preferably at 100 to 150° C., more preferably at 110 to 150° C. Note that the acrylic resin emulsion usually tends to migrate in the direction of the surface layer of the non-woven fabric as drying proceeds, and therefore, the solidified acrylic resin tends to be unevenly distributed on the surface layer.

Then, by performing heated roll processing on the napped surface of the non-woven fabric of ultrafine filaments that has a napped surface on the surface thereof and in which the acrylic resin is further applied, the napped fibers present on the napped surface are fixed with the softened acrylic resin while being laid down.

As the method for performing the heated roll processing, it is preferable to use a method such as calendering or sanforizing that involves heating the surface of the non-woven fabric while pressing the non-woven fabric by bringing into contact therewith a heated roll rotating in one direction. With such a method using a heated roll, the smoothness of the napped surface is increased as a result of the napped fibers being laid down in one direction, thus achieving a better nubuck touch. As the temperature condition for the heated roll, a temperature that allows the napped fibers to be softened and laid down without fusing the napped fibers with one another and softens the acrylic resin may be selected as appropriate. Specifically, it is preferable to set the temperature of the heated roll to a temperature that is higher than the glass transition temperature of the acrylic resin and is higher than the softening temperature of the ultrafine filaments but is lower than the melting point temperature thereof, in view of the point that the napped fibers can be softened to an extent that they are not fused to one another and the acrylic resin can be sufficiently softened. Note that when the ultrafine fibers are polyester fibers having an endothermic sub-peak, the endothermic sub-peak temperature is the softening temperature.

In this manner, the nubuck-finished leather-like sheet of the present embodiment is obtained. Note that the nubuck-finished leather-like sheet of the present embodiment may be further subjected to a flexibilizing treatment by crumpling to adjust the texture, or a finishing treatment such as a reverse seal brushing treatment, an antifouling treatment, a hydrophilization treatment, a lubricant treatment, a softener treatment, an antioxidant treatment, an ultraviolet absorber treatment, a fluorescent agent treatment and a flame retardant treatment.

Preferably, the nubuck-finished leather-like sheet of the present embodiment has air-permeability. For example, the nubuck-finished leather-like sheet has an air-permeability of preferably about 7.5 to 30 cc/cm$^2$/sec, more preferably about 7.0 to 20 cc/cm$^2$/sec, as measured with a Gurley type densometer.

Hereinafter, the present invention will be described more specifically by way of examples. It should be appreciated that the present invention is by no means limited by the examples.

Example 1

Ethylene-modified polyvinyl alcohol (ethylene unit content: 8.5 mol %, degree of polymerization: 380, saponification degree: 98.7 mol %) as a thermoplastic resin serving as a sea component, isophthalic acid-modified PET (isophthalic acid unit content: 6.0 mol %, melting point peak temperature: 242° C., endothermic sub-peak temperature: 110° C.) as a thermoplastic resin serving as an island component were molten separately. Then, each of the molten resins was supplied to a multicomponent fiber spinning spinneret having many nozzle holes disposed in parallel, such that a cross section on which 25 island component portions having uniform cross-sectional areas were distributed in the sea component can be formed. At this time, the molten resins were supplied while adjusting the pressure such that the mass ratio between the sea component and the island component satisfies Sea component/Island component=25/75. Then, the molten resins were discharged from the nozzle holes set at a spinneret temperature of 260° C.

Then, the molten fibers discharged from the nozzle holes were stretched by suction by using an air jet nozzle suction apparatus with an air stream pressure regulated so as to provide an average spinning speed of 3700 m/min, and thereby to spin island-in-the-sea composite filaments with an average fineness of 2.1 dtex. The spun island-in-the-sea composite filaments were continuously piled on a movable net while being suctioned from the back side of the net. The piled amount was regulated by regulating the movement speed of the net. Then, in order to suppress the fuzzing on the surface, the island-in-the-sea composite filaments piled on the net were softly pressed with a metal roll at 42° C. Then, the island-in-the-sea composite filaments were removed from the net, and allowed to pass between a grid-patterned metal roll having a surface temperature of 75° C. and a back roll, thereby hot pressing the fibers with a linear load of 200 N/mm. In this manner, a filament web having a weight per area of 34 g/m$^2$ and in which the fibers on the surface were temporarily fused in a grid pattern was obtained.

Next, an oil solution mixed with an antistatic agent was sprayed to the surface of the obtained filament web, and thereafter, 10 sheets of the filament web were stacked by using a cross lapper apparatus to form a superposed web with a total weight per area of 340 g/m$^2$, and an oil solution for preventing the needle from breaking was further sprayed thereto. Then, the superposed web was needle-punched, thereby performing a three-dimensional entangling treatment. Specifically, the stacked body was needle-punched at a density of 3300 punch/cm$^2$ alternately from both sides by using 6-barb needles with a distance of 3.2 mm from the needle tip to the first barb at a punching depth of 8.3 mm. The area shrinkage by the needle punching was 18%, and the weight per area of the entangled web after the needle punching was 415 g/m$^2$.

The obtained entangled web was densified by being subjected to a heat-moisture shrinking treatment in the following manner. Specifically, water at 18° C. was uniformly sprayed in an amount of 10 mass % to the entangled web, and the entangled web was heat-treated by being stood still in an atmosphere with a temperature of 70° C. and a relative humidity of 95% for 3 minutes with no tension applied, thereby heat-moist shrinking the entangled web so as to increase the apparent fiber density. The area shrinkage by the heat-moisture shrinking treatment was 45%, and the densified entangled web had a weight per area of 750 g/m$^2$ and an apparent density of 0.52 g/cm$^3$. Then, for further densification, the entangled web was pressed with a dry-heat roll, thereby adjusting the apparent density to 0.60 g/cm$^3$.

Next, polyurethane was impregnated into the densified entangled web in the following manner. A polyurethane emulsion (solid content concentration: 30%) composed mainly of polycarbonate/ether polyurethane was impregnated into the densified entangled web. Then, the entangled web was dried in a dryer machine at 150° C.

Next, the entangled web in which the polyurethane had been provided was immersed in hot water at 95° C. for 20 minutes to remove the sea component contained in the island-in-the-sea composite filaments by extraction, and then was dried in a dryer machine at 120° C., thereby obtaining a fiber structure containing a non-woven fabric of ultrafine filaments and the polyurethane impregnated therein. The obtained fiber structure contained 15 parts by mass of polyurethane per 100 parts by mass of the non-woven fabric. Then, the obtained fiber structure was sliced and the surface was napped by being buffed. In this manner, a base material including polyurethane and a non-woven fabric was obtained, the base material including a non-woven fabric of ultrafine filaments with a fineness of 2 dtex and on which napped fibers were formed by napping the surface thereof.

The napped base material had a thickness of 1.2 mm and a weight per area of 695 g/m$^2$. In addition, the length of the napped fibers was about 80 μm.

Then, the base material was scalded in hot water at 80° C. for 20 minutes to relax the fabric with the hot water, and subsequently dyed into brown by using a high-pressure jet dyeing machine (circular dyeing machine from HISAKA WORKS, LTD.).

Next, a resin solution containing 60 parts by mass of an acrylic resin emulsion (KASESOL ARS-2 manufactured by NICCA CHEMICAL CO., LTD., which is an emulsion of an acrylic resin having a Tg of −10° C.) and 50 parts by mass of a softener (emulsion of Oil GR-50 manufactured by Toyoshima Chemical CO., LTD.) was impregnated into the dyed base material by dip-nipping such that a pick-up of 50% was achieved. Note that the solid content concentration of the acrylic resin in the resin solution was 50 g/L, and the effective component concentration of the softener was 100 g/L. Then, the base material was dried with hot air at 120° C. blown thereto from the surface side, thereby causing the acrylic resin to migrate to the surface layer and be solidified. The acrylic resin content was 5 parts by mass per 100 parts by mass of the non-woven fabric.

Then, the base material in which the acrylic resin was provided was subjected to calendering, thereby fixing the laid-down napped fibers with the acrylic resin that had been softened and made malleable. Note that the cylinder temperature of a calender roll used for calendering was set at 130° C.

In this manner, a nubuck-finished leather-like sheet was obtained that included a non-woven fabric that is an entangled body of ultrafine filaments with a fineness of 0.08 dtex and in which the napped fibers are fixed with the acrylic resin while being laid down on the napped surface. FIGS. 1 and 2 are cross-sectional and top SEM images of the nubuck-finished leather-like sheet obtained in the present example.

Then, the obtained nubuck-finished leather-like sheet was evaluated for the texture, the touch, the writing property, and the air-permeability in the following manner. The results are summarized in Table 1.

[Surface Appearance]

The appearance of the obtained nubuck-finished leather-like sheet was observed visually, and determined according to the following criteria.

A: Appearance of a nubuck-finished leather was observed.

B: Appearance of a suede-finished leather was observed.

C: Appearance of a full grain-finished leather was observed.

[Slimy Touch]

The surface of the obtained leather-like sheet was touched with a finger, and the difference in slimy touch and tactile impression with a natural nubuck-finished leather was determined according to the following criteria.

A: Slimy touch equivalent to that of a natural nubuck-finished leather was sensed.

B: Slimy touch slightly lower than that of a natural nubuck-finished leather was sensed.

C: Slimy touch clearly lower than that of a natural nubuck-finished leather was sensed.

[Writing Property]

The surface of the obtained leather-like sheet was traced with a finger and the susceptibility to the remaining finger trace was determined according to the following criteria. Note that a higher susceptibility to the remaining finger trace indicates a larger movement of the napped fibers.

A: Slight finger trace comparable to that would remained in a natural nubuck-finished leather remained.

B: Significant finger trace greater than that would remain in a natural nubuck-finished leather remained.

C: No trace remained.

[Air-Permeability]

The air-permeability was measured with a Gurley type densometer (air passage area=6.42 cm$^2$) in accordance with JIS L 1096B, and determined according to the following criteria.

A: 7.5 cc/cm$^2$/sec or more

B: Less than 7.5 cc/cm$^2$/sec

TABLE 1

| | Ultrafine | | Surface layer resin | | | Evaluation results | | | |
|---|---|---|---|---|---|---|---|---|---|
| Example No. | fibers Fineness (dtex) | Napped fibers Direction | Type | Ratio (parts by mass) | Surface appearance | Slimy touch | Writing property | Air-permeability (cc/cm$^2$/sec) |
| 1 | 0.08 | Laid-down | Acrylic | 5 | A | A | A | A (7.9) |
| 2 | 0.08 | Laid-down | Acrylic | 10 | A | A | A | A |
| 3 | 0.08 | Laid-down | Acrylic | 0.5 | A | A | A | A |
| 4 | 0.08 | Laid-down | Acrylic | 1 | A | A | A | A |
| 5 | 0.08 | Laid-down | Acrylic | 3 | A | A | A | A |
| 6 | 0.08 | Laid-down | Acrylic | 20 | A | A | A | A |
| Comp. Ex. 1 | 0.08 | Laid-down | Acrylic | 40 | C | B | C | B (7.1) |
| Comp. Ex. 2 | 0.08 | Laid-down | — | — | B | C | A | A |
| Comp. Ex. 3 | 0.08 | Vertical | Acrylic | 5 | B | C | A | A |
| Comp. Ex. 4 | 0.08 | Laid-down | Urethane | 5 | B | C | C | A |
| Comp. Ex. 5 | 2.5 | Laid-down | Acrylic | 5 | B | C | B | A |

Examples 2 to 6

Nubuck-finished leather-like sheets were obtained in the same manner as in Example 1 except that the amount of the acrylic resin serving as the surface layer resin was changed to the amounts listed in Table 1 by adjusting the pick-up, instead of setting the amount to 5 parts by mass per 100 parts by mass of the non-woven fabric, and the obtained nubuck-finished leather-like sheets were evaluated. The results are shown in Table 1.

Comparative Example 1

A leather-like sheet was obtained in the same manner as in Example 1 except that the amount of the acrylic resin serving as the surface layer resin was changed to 40 parts by mass per 100 parts by mass of the non-woven fabric by adjusting the pick-up, instead of setting the amount of the acrylic resin serving as the surface layer resin to 5 parts by mass per 100 parts by mass of the non-woven fabric, and the obtained leather-like sheet was evaluated. Note that the obtained leather-like sheet was a full grain-finished leather-like sheet having a grain-finished film formed on the surface thereof. The results are shown in Table 1.

Comparative Example 2

A nubuck-finished leather-like sheet was obtained in the same manner as in Example 1 except that the step of including the acrylic resin was omitted and the non-woven fabric of ultrafine filaments was subjected to calendering, and the obtained nubuck-finished leather-like sheet was evaluated. The results are shown in Table 1. Note that FIGS. 3 and 4 are cross-sectional and top SEM images of the nubuck-finished leather-like sheet obtained in the present comparative example.

Comparative Example 3

A nubuck-finished leather-like sheet was obtained in the same manner as in Example 1 except that the step of subjecting the base material to calendering after inclusion of the acrylic resin was omitted, and the obtained nubuck-finished leather-like sheet was evaluated. The results are shown in Table 1.

Comparative Example 4

A nubuck-finished leather-like sheet was obtained in the same manner as in Example 1 except that the step of including a urethane resin in the following manner was provided in place of the step of including the acrylic resin, and thereafter the base material was subjected to calendering, and the obtained nubuck-finished leather-like sheet was evaluated. The results are shown in Table 1.

(Step of Including Urethane Resin)

A resin solution containing 40 parts by mass of a polyurethane emulsion at a solid content concentration of 40 mass % (polyurethane emulsion manufactured by NICCA CHEMICAL CO., LTD.) and 50 parts by mass of a softener (emulsion of Oil GR-50 manufactured by Toyoshima Chemical CO., LTD.) was impregnated by dip-nipping into the dyed base material such that a pick-up of 50% was achieved. Note that the solid content concentration of the polyurethane in the resin solution is 50 g/L, and the effective component concentration of the softener was 100 g/L. Then, the base material was dried with hot air at 120° C. blown thereto from the surface side, thereby causing the polyurethane to migrate to the surface layer and be solidified. The polyurethane content was 1 part by mass per 100 parts by mass of the non-woven fabric.

Comparative Example 5

A non-woven fabric of regular fibers with a thickness of 1.75 mm and an apparent density of 0.25 g/cm$^3$ that had been formed from PET filaments with a 2.5 dtex and included napped fibers formed by napping the surface thereof was provided, instead of providing a non-woven fabric of ultrafine filaments in Example 1. Then, a leather-like sheet was obtained in the same manner as in Example 1 except that the non-woven fabric of regular fibers that included napped fibers formed thereon was used in place of the non-woven fabric of ultrafine filaments, and the obtained leather-like sheet was evaluated. The results are shown in Table 1.

A slimy touch equivalent to that of a natural nubuck-finished leather was sensed from each of the nubuck-finished leather-like sheets obtained in Examples 1 to 6. On the other hand, the leather-like sheet of Comparative Example 1, in which the acrylic resin content was changed to 40 parts by mass per 100 parts by mass of the non-woven fabric, was a full grain-finished leather-like sheet in which a grain-finished film from which the napped surface had been lost was formed, and therefore, had low air-permeability. The leather-like sheet of Comparative Example 2, in which the step of including the acrylic resin was omitted and calendering was performed, had the appearance of a suede-finished leather and provided an inferior slimy touch. The leather-like sheet of Comparative Example 3, in which calendering was not performed, had the appearance of a suede-finished leather and a slimy touch was hardly sensed. In the case of the leather-like sheet of Comparative Example 4, in which the urethane resin was used in place of the acrylic resin, the napped fibers were not fixed because the urethane resin was not made malleable as the acrylic resin, resulting in the appearance of a suede-finished leather with a large movement of the napped fibers.

INDUSTRIAL APPLICABILITY

A nubuck-finished leather-like sheet obtained by the present invention can be preferably used as a skin material for clothing, shoes, articles of furniture, general merchandise, and the like.

REFERENCE SIGNS LIST

1 . . . Ultrafine filament
1*a* . . . Napped fiber
2 . . . Acrylic resin
3 . . . Elastic polymer
v . . . Void

The invention claimed is:

1. An artificial leather, comprising:

a non-woven fabric that is an entangled body of ultrafine filaments with a fineness of 2 dtex or less;

wherein:

the non-woven fabric is impregnated with a polyurethane so that the polyurethane is present in internal voids of the non-woven fabric;

at least one surface of the non-woven fabric is prepared by napping ultrafine filaments at the at least one surface to obtain napped fibers, applying an acrylic resin to the at least one surface, and subjecting the at least one surface to heated roll processing by calendering so that the napped fibers are fixed to the acrylic resin on the at least one surface while being laid down and not being fused to one another;

the acrylic resin comprises a softener;

the acrylic resin is present in an amount of 1 to 20 parts by mass per 100 parts by mass of the non-woven fabric; and the acrylic resin is discontinuously present on the at least one surface.

2. The artificial leather according to claim 1, wherein the napped fibers have an average length of 50 to 200 μm.

3. The artificial leather according to claim 1, wherein the non-woven fabric is an entangled body of ultrafine filaments with a fineness of 0.2 dtex or less.

4. The artificial leather according to claim 1, wherein the artificial leather has an air-permeability of 7.5 to 30 cc/cm$^2$/sec, as measured with a Gurley type densometer.

5. A method of producing an artificial leather, comprising:

dyeing a base material comprising a non-woven fabric comprising an entangled body of ultrafine filaments with a fineness of 2 dtex or less, the non-woven fabric being impregnated with polyurethane and having napped fibers on at least one surface;

impregnating an acrylic resin composition into the dyed base material at the at least one surface, the acrylic resin composition comprising a resin solution of an acrylic resin and a softener;

drying the resin solution to migrate in the direction of the at least one surface of the base material to solidify the acrylic resin; and performing heated roll processing by calendering on the at least one surface of the base material so that the napped fibers are fixed to the acrylic resin on the at least one surface while being laid down and not being fused to one another to obtain the artificial leather;

wherein:

the acrylic resin composition is applied such that, in the artificial leather, the acrylic resin is present in an amount of 1 to 20 parts by mass per 100 parts by mass of the non-woven fabric; and in the artificial leather, the acrylic resin is discontinuously present on the at least one surface.

* * * * *